US005150846A

United States Patent [19]

Giust et al.

[11] Patent Number: 5,150,846

[45] Date of Patent: Sep. 29, 1992

[54] UNIVERSAL DEVICE FOR WINDING CORDS, CABLES AND SUCHLIKE

[75] Inventors: Henri Giust, Trezzano Sul Naviglio; Ennio Cippelletti, Roma, both of Italy

[73] Assignee: Somfy, Cluses, France

[21] Appl. No.: 548,095

[22] Filed: Jul. 5, 1990

[30] Foreign Application Priority Data

Jul. 17, 1989 [IT] Italy ..... 21444/89[U]

[51] Int. Cl.[5] ..... B65H 75/24; B65H 75/28; B65H 75/02

[52] U.S. Cl. ..... 242/54 R; 242/100.1; 242/73

[58] Field of Search ..... 242/54 R, 73, 100, 100.1, 242/107.13, 106, 96

[56] References Cited

U.S. PATENT DOCUMENTS

| | | | |
|---|---|---|---|
| 215,073 | 5/1879 | Simms et al. | 242/73 |
| 599,504 | 2/1898 | Hopkins | 242/106 |
| 2,206,174 | 7/1940 | Falk | 242/100.1 |
| 2,547,777 | 4/1951 | Ray | 242/107.13 |
| 2,989,267 | 6/1961 | Mehl | 242/100.1 |
| 3,096,884 | 7/1963 | Leshner | 242/100 |
| 3,572,599 | 3/1971 | Hilmer | 242/54 R |
| 4,046,331 | 9/1977 | Decker, Sr. | 242/54 R |
| 4,089,486 | 5/1978 | Carter | 242/129 |
| 4,453,680 | 6/1984 | Miller | 242/106 |
| 4,721,833 | 1/1988 | Dubay | 242/54 R |

FOREIGN PATENT DOCUMENTS

| | | | |
|---|---|---|---|
| 486005 | 8/1952 | Canada | 242/100.1 |
| 64032 | 5/1968 | German Democratic Rep. | 242/100.1 |
| 2106863 | 4/1983 | United Kingdom | 242/100.1 |

*Primary Examiner*—Daniel P. Stodola
*Assistant Examiner*—John Q. Nguyen
*Attorney, Agent, or Firm*—Laff, Whitesel, Conte & Saret

[57] ABSTRACT

The device comprises a containing box of substantially cylindrical shape in which a motorized drum is rotatively mounted with guiding rings thereon which can be fitted in different positions. The end of the cords to be wound up are fitted to said rings and the cords are wound up through a slot of the box. The number and position of the rings can be adjusted according to the number and length of the cords to be wound up.

4 Claims, 1 Drawing Sheet

UNIVERSAL DEVICE FOR WINDING CORDS, CABLES AND SUCHLIKE

FIELD OF THE INVENTION

The present invention relates to a universal device for winding cords, cables and suchlike, particularly for the motorizing of hangings and fittings in general.

PRIOR ART

Various systems are known for automatically actuating hangings, lights, panels, furniture and fittings in general.

Generally these systems comprise an electric motor which actuates one or more pulleys to wind cords or leads connected to the element to be moved.

The systems proposed are generally designed and produced for the specific use for which they are intended and it is hence difficult, if not impossible, to adapt a motorizing system for a use differing from that envisaged.

SUMMARY OF THE INVENTION

The principal object of the present invention is that of producing a universal device for winding cords, cables and suchlike, which is adaptable without major modifications to diverse uses and hence of very little bulk and easy to fix up.

Within the scope of this object, one aim of the invention is that of producing a device of compact structure which is easy to make from the production point of view.

Another aim is that of producing an economical device both from the production point of view and from that of installation and use.

This object, and these and other aims which will appear more clearly later, are achieved with a universal device for winding cords, cables and suchlike comprising a motor associated with a drum capable of winding a plurality of traction elements such as cords, cables and suchlike, comprising a containing box element of substantially cylindrical shape and having a lengthwise slot directed along the box, the box being closed at its ends by respective supports capable of supporting the ends of the drum, the drum being rotatable within the box and being provided with elements which guide and lock the traction elements, the traction elements being able to wind themselves around the drum by passing through the slot.

BRIEF DESCRIPTION OF THE DRAWINGS

Further characteristics and advantages will emerge more clearly from the description of the invention which is illustrated by way of indication and without limitation in the attached drawings in which.

DESCRIPTION OF THE PREFERRED EMBODIMENT

Figure 3:
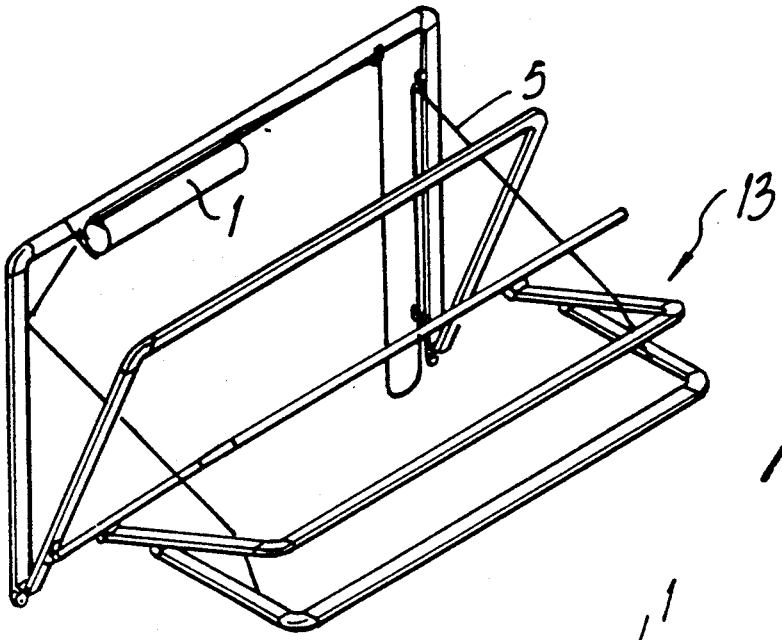
FIG. 3 is a perspective view of a hanging awning motorized by the device according to the invention.
Figure 1:
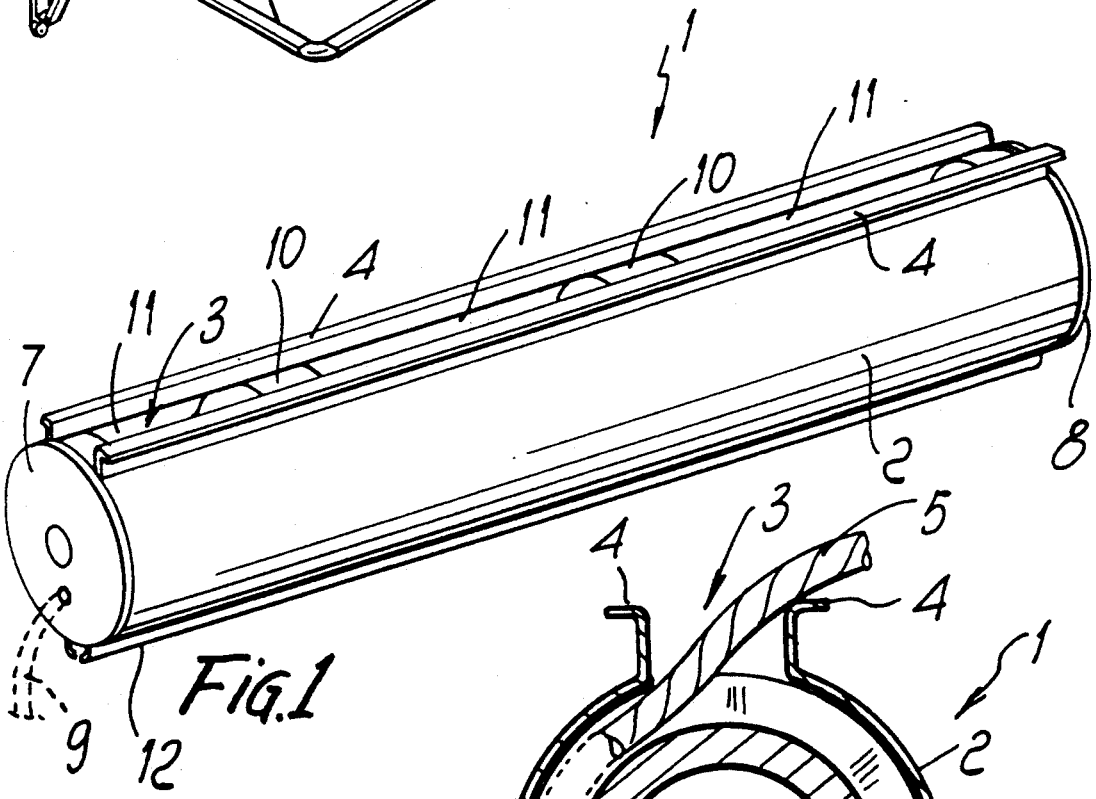
FIG. 1 is a perspective view of the device according to the invention.
Figure 2:
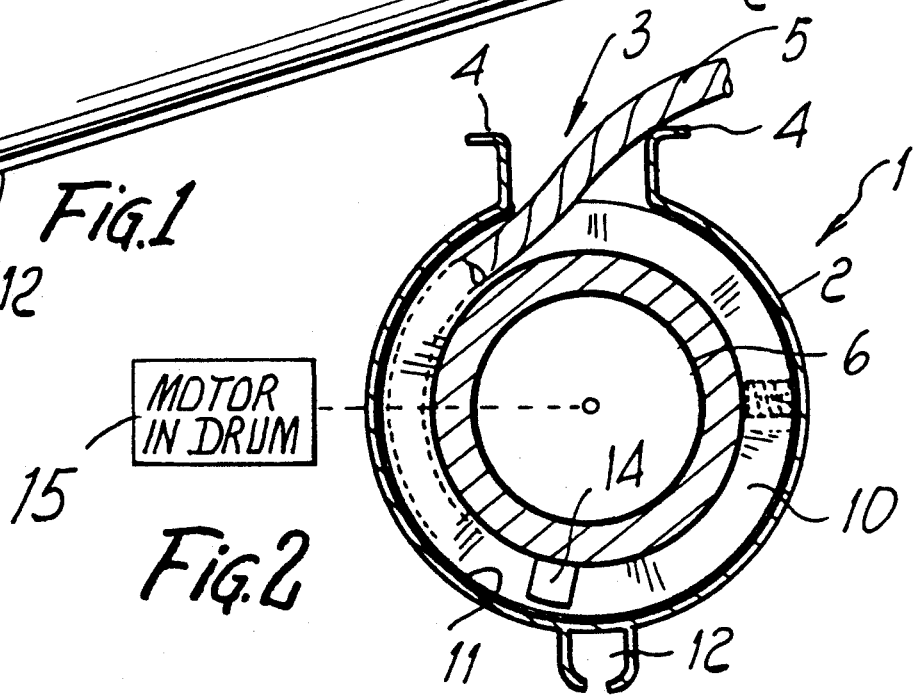
FIG. 2 is a cross-section of the device of FIG. 1.

With reference to the figures mentioned, the device, indicated as a whole by the reference numeral 1, comprises a containing box body, or casing 2, which has a substantially cylindrical shape and has a lengthwise slot 3, arranged according the casing.

The slot 3 further comprises rounded edges 4 to help in drawing in one or more traction elements, such as a cord 5.

The cord 5 winds onto a drum 6 located inside the casing 2 and supported at the ends by supports 7 and 8 which constitute the end caps of the casing 2.

The winding drum 6 is advantageously actuated by an electric motor is located inside the said drum and of which only the supply cable 9 is visible.

Advantageously applied to the drum 6 are elements for guiding and locking the traction elements, which preferably consist of rings 10, which can slide along the drum 6 and can lock in the desired position, to define the openings for winding according to the desired dimensions.

The rings 10 also have means for locking the end of each cord 5, which consist for example of screws in a way known per se.

A ring may also have a hole, or an axial milled portion 14 in such a way as to allow the passage of a cord whose ends are connected to the user fitting in such a way as to wind the cord symmetrically through two adjacent openings separated by the ring.

Advantageously, the distance between the outer winding surface of the drum and the inner surface of the casing is about equal to the cross-section of the cord to be wound, so that the cord winds up in successive adjacent coils without lying on top of itself.

The operation of the device is very simple: the number and position of the rings is first adjusted according to the number and length of the cords to be wound up.

Then the end of each cord is locked to one of the rings and the device is ready for use.

To facilitate installation of the device in any kind of apparatus, the casing 2 is given an external channel 12 which runs along the casing, in the case illustrated opposite the slot 3; various anchoring means may be applied to the channel 12, as for example feet.

By way of an example in FIG. 3 there is illustrated one of the countless possible uses for the device according to the invention, which is shown applied to a hanging awning 13, of the kind used to protect shop windows from the sun.

The device is used to fold and open the hanging by being applied so as to wind up the cords 5 of the hanging.

It is found in practice that the invention achieves the object and aims set beforehand, making it possible to produce a universal device capable of being applied to countless appliances, and fittings in general, with few and very simple modifications.

The device according to the invention can be used for example to actuate domestic hangings, sliding wall panels or furniture, ceiling lights, and suchlike.

An important advantage of the invention is that derived from its extreme structural compactness which makes it versatile and easy to install.

Another important advantage lies in the system of rings which makes it possible to use the device to wind up any number of cords.

A further advantage is given by the shape of the casing which, owing both to the shape of the receiving slot and to the internal cross-section of winding, makes it possible to wind the cords in the optimum way.

Not the last advantage is given by the cleanness of the lines which provide a pleasing aesthetic appearance which can be adapted to the most varied uses.

Naturally the materials used, and the dimensions, may be of any kind according to requirements and the state of the art.

We claim:

1. A winding device which can be used in a variety of installations for winding a plurality of traction elements, said traction elements including cords or cables, comprising:

a substantially cylindrical box, said box having a longitudinal lengthwise slot, a winding drum within said box onto which said traction elements can be repeatedly wound and unwound, said winding drum being rotatable within said box, the difference between the inner diameter of said box and the outer diameter of said drum is substantially equal to twice the diameter of said traction element to force each said traction element to wind itself onto said drum in adjacent coils without said coils lying on top of each other;

said traction elements being able to wind themselves around said drum by passing through said slot, a motor to rotate said winding drum, a pair of end supports closing the ends of said box and supporting said winding drum for rotation, a plurality of removably adjustable lock and associated guide means within said box and slidable on said drum to guide and lock said traction elements on said drum, each of said lock and guide means consists of a ring and an associated lock wherein said ring can be releasably locked onto said drum in any desired position by its associated lock and is able to receive and lock the end of a traction element, the outer diameter of said ring being substantially equal to the inner diameter of said box, whereby the positions of said lock and guide means adjustably determine the number and length of said traction elements that can be accommodated for each installation of the winding device.

2. The device as claimed in claim 1, wherein said box is provided with an outer channel running lengthwise along said box and able to receive means for locking said device to a structure.

3. The device as claimed in claim 1 wherein said motor is electric.

4. The device as claimed in claim 1, wherein said motor is located inside said drum.

* * * * *